United States Patent [19]

Follows

[11] 4,285,484

[45] Aug. 25, 1981

[54] SHELF AND CLOTHES ROD ASSEMBLY FOR A CLOSET

[76] Inventor: James S. Follows, 19239-96th Ave., Surrey, British Columbia, Canada, V3T 4W2

[21] Appl. No.: 46,405

[22] Filed: Jun. 7, 1979

[51] Int. Cl.[3] ..... A47B 57/00

[52] U.S. Cl. ..... 248/235; 108/29

[58] Field of Search ..... 108/29–31, 108/109; 248/235, 239; 211/90; 85/72

[56] References Cited

U.S. PATENT DOCUMENTS

| | | | |
|---|---|---|---|
| D. 189,918 | 3/1961 | Nordenson | 248/235 X |
| 1,398,071 | 11/1921 | Forester | 211/90 |
| 2,657,894 | 11/1953 | Sklenar | 248/239 |
| 2,956,468 | 10/1960 | Macy | 85/72 |
| 3,099,931 | 8/1963 | Ferdinand | 248/239 X |
| 3,471,112 | 10/1969 | MacDonald et al. | 108/109 X |
| 3,637,183 | 1/1972 | Sagers | 248/235 |
| 3,765,295 | 10/1973 | Ptak | 85/72 |
| 3,865,336 | 2/1975 | Robertson | 211/90 X |

FOREIGN PATENT DOCUMENTS

| | | | |
|---|---|---|---|
| 1248557 | 10/1971 | United Kingdom | 85/72 |

*Primary Examiner*—Francis K. Zugel

*Attorney, Agent, or Firm*—Christensen, O'Connor, Johnson & Kindness

[57] ABSTRACT

A shelf and clothes rod assembly for a closet includes a shelf and a clothes rod supported at their opposite ends by single piece closet fittings affixed to opposing closet walls. Each fitting comprises a first solid wall to abut a wall of the closet. A second wall is longitudinal of and substantially perpendicular to the first wall and supports a shelf when the fitting is in its useful position. A rod-receiving recess defined by a curved wall is formed on the first wall, below the second wall when its fitting is in its useful position. There are means in said first wall to permit mounting of the fitting on a closet wall. The fitting is durable and extremely easy to position.

5 Claims, 5 Drawing Figures

2
4
16
32
24
18
20
26
22
27
28
8
10
6
12
14

2
4
16
32
28
20
18
24
22

2
4
16
8
10
6
26
27
14

SHELF AND CLOTHES ROD ASSEMBLY FOR A CLOSET

FIELD OF THE INVENTION

This invention relates to a single piece closet fitting useful to support a shelf in a closet and also to provide a support for a rod, for example a rod to receive coat hangers.

In a further aspect the invention relates to a novel mounting means for the fitting.

DESCRIPTION OF PRIOR ART

The most popular method of mounting a shelf in a closet is simply to provide wooden strips around the walls of the closet and to rest the shelf on those surfaces. The formation of rod receiving means is usually done by the provision of circular recesses formed either in the faces of the strips or hanging from the shelf.

In order to install the rod into the recesses it is usually necessary either to have an expanding rod or to position the rod within the recesses before the shelf-supporting strips are attached to the wall. In addition the strength of these fittings can be inadequate for heavy loads, particularly loads mounted on the shelf.

However brackets for mounting closet shelves and poles or rods are also known. For example U.S. Pat. No. 3,284,040 to Marontate issued Nov. 8, 1976 discloses a shelf and pole bracket having a rib structure that is designed specifically to be reversible. The Marontate device is built of a framework to ensure that the brackets are reversible. The mounting means disclosed in Marontate is such that the bracket cannot be mounted with a substantial proportion of the area of the bracket in contact with the wall. It is particularly important, in the present application, that the mounting means be mounted wholly in shear, that is the load is applied only as a shear load and this is not a feature of Marontate, largely because Marontate is particularly concerned to produce a reversible bracket.

SUMMARY OF THE INVENTION

The present invention seeks to provide a shelf and clothes rod assembly including a pair of single piece closet fittings, which, in tests on a prototype, is easily able to support the weight of an average man. The closet fitting is provided with rod and shelf receiving recesses of a simple design and from which the rod and shelf can easily be removed after installation. It follows, of course, that the rod and shelf can be inserted in position after the closet fittings have been installed.

Thus, in a first aspect, the present invention is a shelf and clothes rod assembly including at each end thereof a single piece closet fitting comprising a first solid wall to abut a wall of the closet; a second wall longitudinal of and substantially perpendicular to the first wall and able to support a shelf when the fitting is in its useful position; a rod-receiving recess defined by a curved wall formed on said first wall, below said second wall when the fitting is in its useful position; and openings formed in said first solid wall, each opening dimensioned to receive an expandable body having an end ring large enough to abut the periphery of the opening whereby an expander member may be driven into said expandable body to expand the body to grip the interior of a hole in the closet wall aligned with an opening in said first wall; said openings being arranged so that, when the fitting is in its useful position with a shelf and a rod extending between an opposed pair of said fittings, there is a plurality of openings in each fitting immediately adjacent an end of the shelf and an opening immediately adjacent an end of the pole, the arrangement being such that the expandable bodies mounting said fittings to the closet wall are always loaded only in shear.

It is usually desirable to include bracing means extending from the first wall to beneath the second walls to support and brace the second wall. As indicated above the second wall is the wall upon which the shelf rests.

It is desirable that there be an end wall extending above the first and second walls to act as stop for the shelf, that is to prevent easy removal of the shelf by sliding along the second wall. Of course this end wall does not prevent lifting of the shelf when it is desired to remove it from the fitting.

In further aspects the invention provides the above closet fittings, packaged in pairs, and a closet shelf and rod mounting system including a pair of the above fittings a shelf and a rod.

It is particularly important to note that the mounting means of the closet fittings of the present invention are such that the expandable bodies that mount said fittings to the closet wall are always loaded only in shear. This particular feature means that the fittings of the present invention are able to withstand extremely high loads without being torn from the wall. Furthermore it should be noted that in the aspect of the invention that comprises a closet shelf and rod mounting system including a pair of the above fittings, a shelf and a rod, the shelf and the rod locate in their positions the expandable bodies and the expander members. These expandable bodies and expander members are driven home before the shelf and rod are installed but once the rod and shelf are installed they act to maintain the mounting means in position. Because of the particular positioning of the mounting means immediately adjacent either an end of the shelf or immediately adjacent an end of the pole the necessary total shear loading is ensured.

BRIEF DESCRIPTION OF DRAWINGS

The invention is illustrated, by way of example, in the accompanying drawings in which.

DESCRIPTION OF THE PREFERRED EMBODIMENTS

Figure 1:
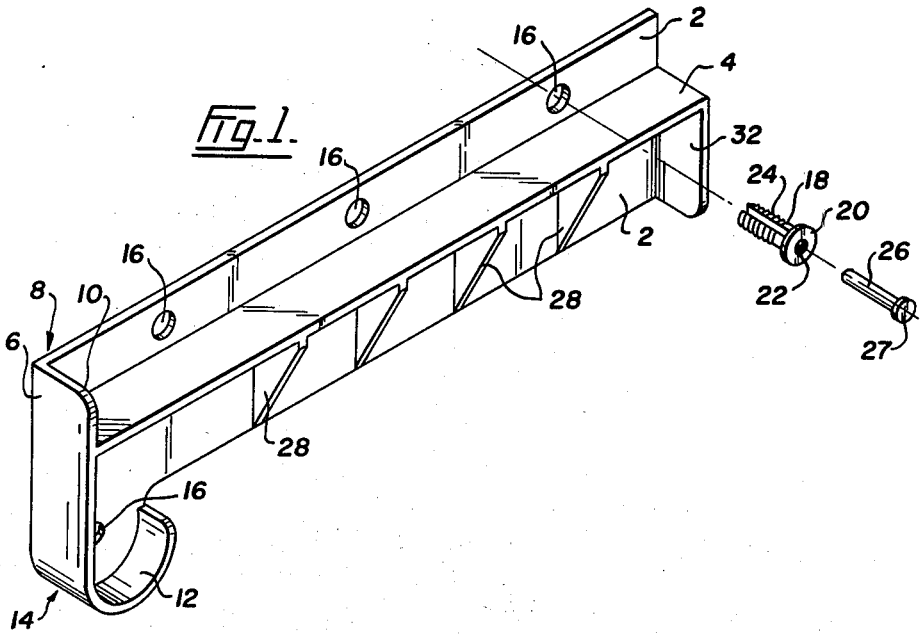
FIG. 1 is a perspective view of a preferred embodiment of the present invention.
Figure 2:
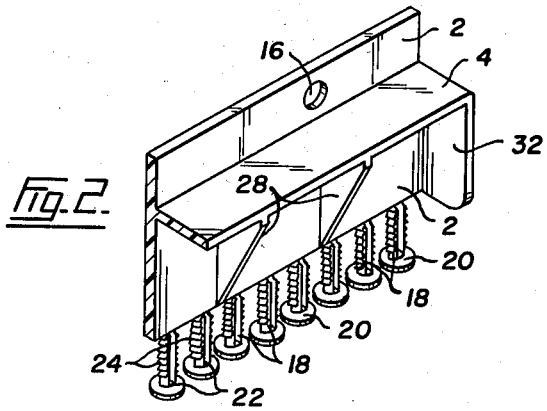
FIGS. 2 and 3 illustrate features of the fitting according to the present invention.
Figure 3:
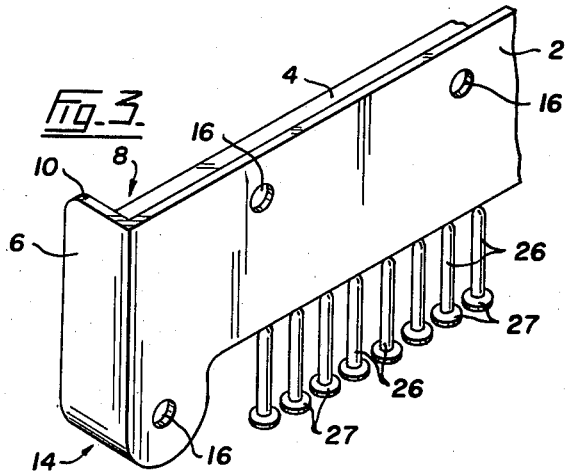

The drawings illustrate a single piece closet fitting comprising a first wall 2 to abut a wall (shown in broken lines in FIG. 4) of the closet. There is a second wall 4 longitudinal of and substantially perpendicular to the first wall 2. The second wall 4 is able to support a shelf 5 (see FIG. 4) when the fitting is in its useful position in a closet.

A third wall 6 is positioned at a first end 8 of the first wall 2 and the second wall 4. The third wall 6 extends substantially perpendicular to both the first wall 2 and the second wall 4. In the illustrated embodiment the third wall 6 projects above the first wall 2 at 10 to act as a stop for the shelf, that is to prevent a shelf supported by the second wall 4 from sliding outwardly.

Figure 4:
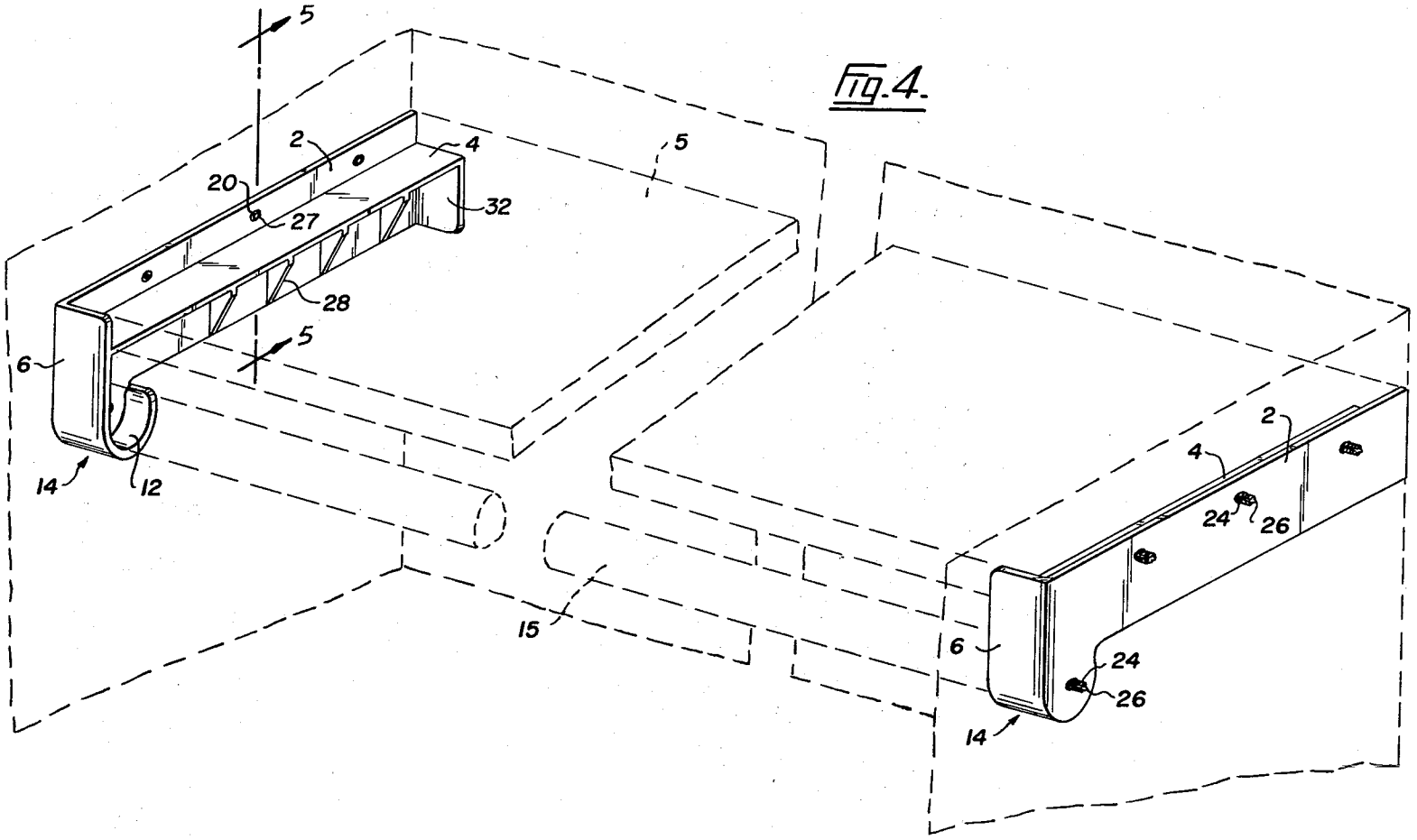
FIG. 4 illustrates a closet shelf and rod mounting system according to the invention.
Figure 5:
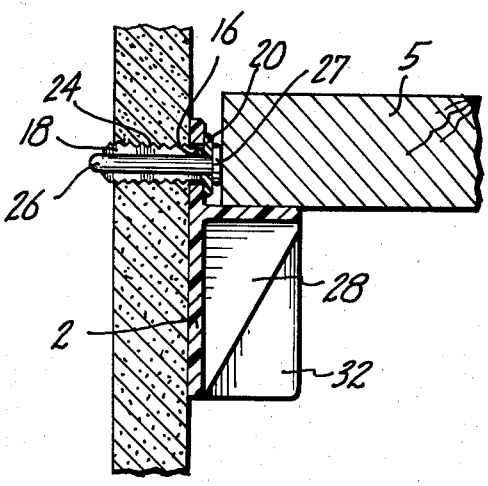
FIG. 5 is a sectional view along section line 5—5 of FIG. 4.

There is a rod receiving recess 12 defined at a first end 14 of the third wall 6 to receive a rod 15 (see FIG. 4).

The first wall 2 is provided with means to permit mounting of the fitting on a closet wall. In the illustrated embodiment these means comprise openings 16 which receive wall engaging members 18 shown exploded in FIG. 1 and in position in FIG. 4. The wall engaging members 18 each comprise an expandable body able to fit through the opening 16. The expandable body is provided with an end ring 20 large enough to abut the periphery of an opening 16. That is the end ring 20 is sufficiently large in diameter that it cannot pass through an opening 16. There is a central core 22 in each wall engaging member 18. Gripping means in the form of teeth 24 are formed on the exterior of the wall engaging members 18. An expander member in the form of a rod 26 is dimensioned so that it can be driven into the central core 22 of the expandable body of the wall engaging member 18. The effect is to expand the body outwardly to grip the interior of an aligned hole in the closet wall. This locates the closet fitting on the closet wall. Rod 26 has a head 27 to facilitate driving of rod 26 into position.

In the preferred illustrated embodiment the illustrated fitting is provided with bracing means in the form of triangular walls 28 extending from the first wall 2 to beneath the second wall 4 to support and brace the second wall 4. The preferred embodiment also has a bracing end wall 32.

FIG. 4 is a perspective view illustrating a closet shelf and rod mounting system comprising two fittings, each adapted to be mounted on a wall of a closet, the fittings being opposed to one another, with a shelf 5 extending between the fittings and a pole 15 extending between the fittings. The drawing is included to illustrate the fact that the mounting means in the form of the wall engaging members 18 and an expander member are located behind a shelf 5 when the shelf and rod are installed and, indeed, cannot normally be seen. Furthermore rod 15 obscures the lower mounting means. This arrangement is to ensure first that the mounting means cannot be removed from the wall while the shelf 5 and the rod 15 are in position and also that the mounting means are loaded only in shear as the only load applied to these members is load positioned on the shelf 5 or on the rod 15. Any possible moment or twisting force which could result in a pulling or horizontal force such as to cause the pin to come out is rebutted by the locking effect of the shelf and rod. Any force on the pin at one end would be transmitted through the shelf or rod and reduced to nil by the equal and opposite reaction force from the opposite wall. A nail or screw put in gyproc (and cheaper wall boards) would simply push the brittle gyproc out of the way, leaving a hole with no gripping power. Members 18 are useable in any building material because they grip the hole in compression and have met tests indicating that it would not even be necessary to have the locking effect of the shelf and rod to ensure proper and secure mounting in gyproc alone. Openings 16 in the bracket should be size for size with the members 18 which also helps eliminate any tendency for members 18 to bend from the horizontal. This, in conjunction with the vertical shear loading, results in pure vertical compression on the gyproc. The diameter and number of pins thus create a condition of compression loading on the gyproc which will withstand any loading without the aid of a supporting stud for mounting. That is conventional wall studs are not required with the bracket of the invention. This stud would be a requirement for other screw or nail mounted brackets. If the wooden strip method is used, then without this intermediate stud, a board long enough to span at least two studs would be required. Even if a stud is in approximately the correct position (and many will not be), the bracket of the invention eliminates the necessity of having to find it and use it for support.

The fitting of the present invention is a cheap and durable closet fitting able to stand considerable weights. In one embodiment the fitting may be molded from polyethylene. Such an embodiment has proved easily able to stand the weight of an average man. The fitting may also be molded from polypropylene or any other plastic having sufficient strength. However, ABS is preferred.

In order to install the fitting it is simply necessary to hold the fitting in a desired, usually level, position against the closet wall without necessarily locating the studs. Marks are made on the wall corresponding to the openings 16. The fitting is then removed and holes are drilled in the closet wall to receive the wall engaging members 18. The fitting is then placed against the wall with the openings 16 aligned with the holes in the closet wall. Wall engaging members 18 are pushed through each opening 16 to engage in the aligned holes in the wall with the ring 20 against the exterior surface of the first wall 2. Rods 26 are then hammered into the central core 22 of the wall engaging members 18 to expand the bodies of the wall engaging members. The teeth 24 on the exterior of the bodies grip the interior of the aligned hole and the device is firmly secured in position. Removal is also easy. It is simply necessary to remove the rods 26. After that the wall engaging members 18 can be removed fairly easily and the fitting taken from the wall.

It should be emphasized that the members 18 greatly facilitate the mounting of this or any article to be mounted in a similar fashion. This arises because (a) ring 20 abuts the exterior of the article to be mounted and does not rest against the wall and (b) the rods 26 are hammered into place, not screwed.

It can be desirable to countersink the inner periphery of ring 20 and to put a corresponding countersink on the underside of the head 27 of rod 26.

The fittings can be packaged in pairs. One fitting having integrally molded to it sufficient members 18 to mount both fittings and the other having molded to it sufficient rods 26. The members 18 and rods 26 can be removed from the fitting by hand prior to use. However, this, of course is only possible when the member 18, rods 26 and the fittings are of the same material. However, a preferred material for the members 18 and rods 26 is polyethylene and the preferred material for the fitting is ABS. Normally the components are formed separately then packaged together.

I claim:

1. A shelf and clothes rod assembly for a closet comprising:

a rigid shelf having end surfaces oriented substantially transversely to the lengthwise axis of said shelf;

a clothes rod having end surfaces oriented substantially transversely to the lengthwise axis of said rod;

a pair of closet fittings adapted for attachment to opposing interior walls of the closet, each fitting having an elongate first solid wall to abut an interior wall of the closet and a second wall longitudinal of and extending transversely from said first wall for supporting an end of said shelf, each fitting further including a curved wall extending from said first wall for supporting an end of said clothes rod, said curved wall being below said second wall when said fitting is attached to said closet wall, each fitting further including a plurality of openings in said first wall, including a plurality of said openings positioned in said first wall to open toward an end surface of said shelf and an opening positioned in said first wall to open toward an end of said clothes rod when the assembly, including the shelf and clothes rod, is installed in the closet;

expansion fastener means associated with said openings of said fittings for attaching said fittings to said closet walls, said fastener means each including an expandable body insertable through an opening of said fitting and into an aligned hole in the wall and an expander member insertable in said expandable body to forcibly expand said expandable body outwardly, each of said expandable bodies further including an integral ring that abuts said first wall of said fitting upon said expandable body being inserted through said opening of said fitting;

said shelf and said clothes rod each being sized in length such that their opposite end surfaces snugly abut said expander members of said expansion fastener means when said fittings are attached to said opposing interior walls of said closet and said shelf and said clothes rod are interposed substantially horizontally between said fittings to bear upon said second walls and said curved walls, respectively, of said fittings.

2. The shelf and clothes rod assembly defined in claim 1 wherein each of said expandable bodies is generally cylindrically shaped and includes radially projecting teeth for gripping the hole in the closet wall upon said expandable body being expanded outwardly by insertion of said expander member.

3. The shelf and clothes rod assembly defined in claim 2 wherein each of said closet fittings further includes bracing means extending from said first wall to beneath said second wall to support and brace said second wall.

4. The shelf and clothes rod assembly defined in claim 3 wherein each of said closet fittings further includes an end wall extending above said second wall to act as a stop for said shelf.

5. The shelf and clothes rod assembly defined in claim 4 wherein each of said closet fittings is molded from plastic.

* * * * *